United States Patent [19]

Parcels

[11] 4,013,051

[45] Mar. 22, 1977

[54] AUTOMOTIVE CRANKCASE EMISSION CONTROL SYSTEM

[76] Inventor: Ross M. Parcels, 2666 Mark Lane, West Linn, Oreg. 97068

[22] Filed: July 8, 1974

[21] Appl. No.: 486,496

[52] U.S. Cl. ..... 123/119 B

[51] Int. Cl.[2] ..... F02M 25/06

[58] Field of Search ..... 123/119 B; 210/323

[56] References Cited

UNITED STATES PATENTS

| | | | |
|---|---|---|---|
| 2,086,739 | 7/1937 | Reed | 210/323 |
| 2,122,119 | 6/1938 | Thibert | 210/323 |
| 3,157,467 | 11/1964 | Daigh et al. | 123/119 B |
| 3,272,192 | 9/1966 | Jensen | 123/119 B |
| 3,313,281 | 4/1967 | Schneider | 123/119 B |
| 3,491,732 | 1/1970 | Dahm et al. | 123/119 B |
| 3,509,967 | 5/1970 | Ballard | 123/119 B |
| 3,533,385 | 10/1970 | Bennett | 123/119 B |
| 3,550,570 | 12/1970 | Watson, Jr. | 123/119 B |
| 3,589,108 | 6/1971 | Dingel et al. | 123/119 B |
| 3,704,698 | 12/1972 | Sarto et al. | 123/119 B |
| 3,765,386 | 10/1973 | Ottofy | 123/119 B |
| 3,779,221 | 12/1973 | Gartner | 123/119 B |
| 3,875,916 | 4/1975 | Patton | 123/119 B |
| 3,877,451 | 4/1975 | Lipscomb | 123/119 B |
| 3,880,130 | 4/1975 | Hecht | 123/119 B |

*Primary Examiner*—Wendell E. Burns
*Attorney, Agent, or Firm*—Eugene M. Eckelman

[57] ABSTRACT

A filter is included in a conventional emission control system of the type wherein crankcase fumes are fed into the fuel intake manifold for burning. Conventional emission control systems include a pollution control valve, and the present system also incorporates such valve in combination with said filter.

2 Claims, 5 Drawing Figures

AUTOMOTIVE CRANKCASE EMISSION CONTROL SYSTEM

BACKGROUND OF THE INVENTION

This invention relates to a new and useful improvement in automotive crankcase emission control systems.

Most vehicles under present day emission control regulations employ means for burning or reburning exhaust or crankcase fumes. It is well established that while such present day systems provide a substantial improvement in the discharge of pollutants from the vehicle exhaust, the performance of the vehicle, including miles per gallon from the fuel burned, is seriously lessened.

SUMMARY OF THE INVENTION

According to the present invention and forming a primary objective thereof, a crankcase emission control system is provided that not only amounts to a substantial improvement in removing pollutants from the exhaust system of the vehicle but also causes the vehicle to get better mileage per gallon of fuel.

A more particular object is to provide a crankcase emission control system that adds a filter to the emission control system presently in use, thus filtering out solids and vapors that generally are passed back to the fuel inlet means of the engine.

Another object of the present invention is to provide a system of the type described that utilizes as the filter a conventional spin-on type filter and which system also has provision for incorporating the usual pollution control valve therein.

The invention will be better understood and additional objects and advantages will become apparent from the following description taken in connection with the accompanying drawings which illustrate preferred forms of the device.

DETAILED DESCRIPTION OF PREFERRED EMBODIMENTS

Figure 1:
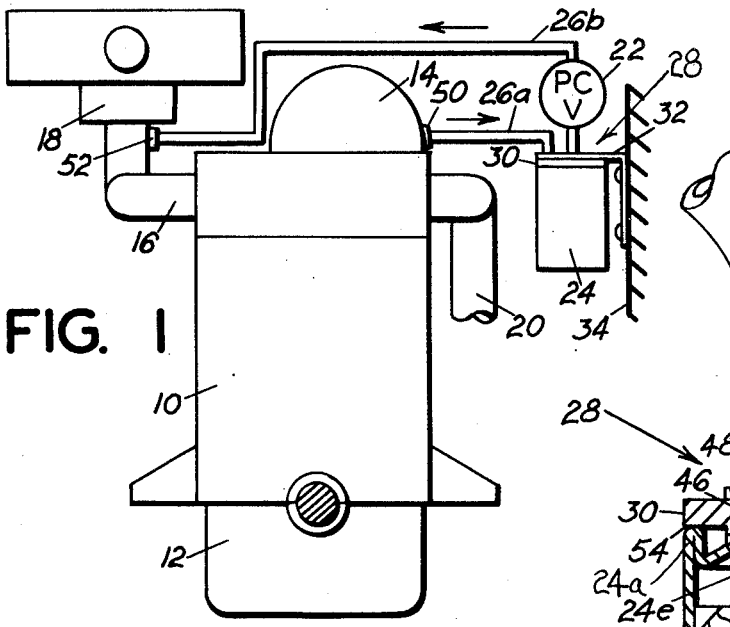
FIG. 1 is an elevational view partly diagrammatic of a vehicle engine and including the present system incorporated thereon.

Referring first to FIG. 1, the numeral 10 designates a conventional engine having a crankcase 12, a valve cover 14, an intake manifold 16, a carburetor 18, and an exhaust manifold 20. According to present theories, much pollution is caused from crankcase vapors and can be lessened by passing the vapors which have escaped from the crankcase into the valve cover 14 back into the carburetor at or near the intake manifold 16. The vapors from the crankcase and valve cover are thus burned with the fuel mixture. Such systems include a pollution control valve (PCV valve) designated in FIGS. 1 and 2 by the numeral 22. In the systems now in use, the pollution control valve is removably attached to the valve cover as by a flexible grommet and has communication with the intake manifold by suitable flexible conduit.

According to the present invention a filter 24 is included in the conduit extending from the valve cover 14 to the intake manifold 16. Conduit sections are designated by numerals **26*a* and 26*b* and are connected to the filter through the medium of a filter support 28. Such support comprises a disc-shaped body member 30 integral with a right angle bracket 32 adapted for attachment in any suitable place in the motor well, such as to the fire wall 34**.

Figure 2:
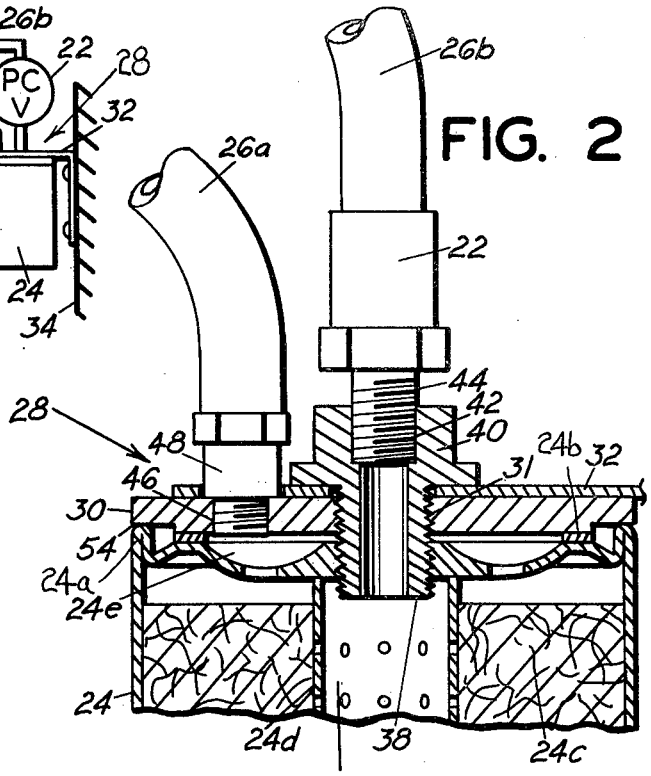
FIG. 2 is an enlarged fragmentary sectional view of a portion of the present apparatus.

With particular reference to FIG. 2, body member 30 has an axial tapped bore 31 threadedly receiving a hollow stud 38 which projects from the lower end of the body member and is of a diameter capable of threadedly receiving a filter 24. The head 40 of the stud 38 has a tapped bore 42 therein for threadedly receiving a fitting 44 of a pollution control valve, the hose section **26*b* extending from the pollution control valve to the intake manifold. Body member 30 also has a tapped bore 46 offset from center and arranged to receive a fitting 48 of the hose section 26*b* that extends from the valve cover 14. Fitting of the one end of hose 26*a* to the valve cover 14 is accomplished by a grommet 50 in the place where a hose or the pollution control valve was formerly mounted. A fitting 52 for the one end of hose section 26*b* at the intake manifold is already present in view of existing structure. Likewise, the connection of the one end of hose section 26*b* to the pollution control valve 22** is conventional.

The bottom surface of body member 30 is suitably contoured to adapt to the type of filter 24 that is used. In a conventional spin-on oil filter presently in common use and one that performs well to carry out the instant invention, the filter has a top annular extension **24*a* arranged to engage firmly against the bottom of the mounting member when the filter is threaded in place, and an annular gasket 24*b* is provided at an inward point for sealing. Body member 30 may have a bottom annular recess 54 for abutment by the extension 24*a*. A filter of the type described receives the product to be filtered inwardly from the outside in, and such product after passing through a filter material 24*c* passes through a perforated hollow center core 24*d* for discharge through stud 38, pollution control valve, and to the intake manifold 16. The filter has an annular recess 24*e*** in its end surface whereby the inlet product flows around the filter for access to the entire filter.

Figure 3:
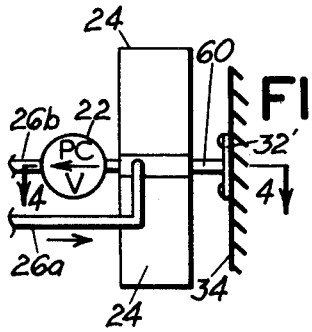
FIG. 3 is an elevational view of a second embodiment of the invention.
Figure 5:
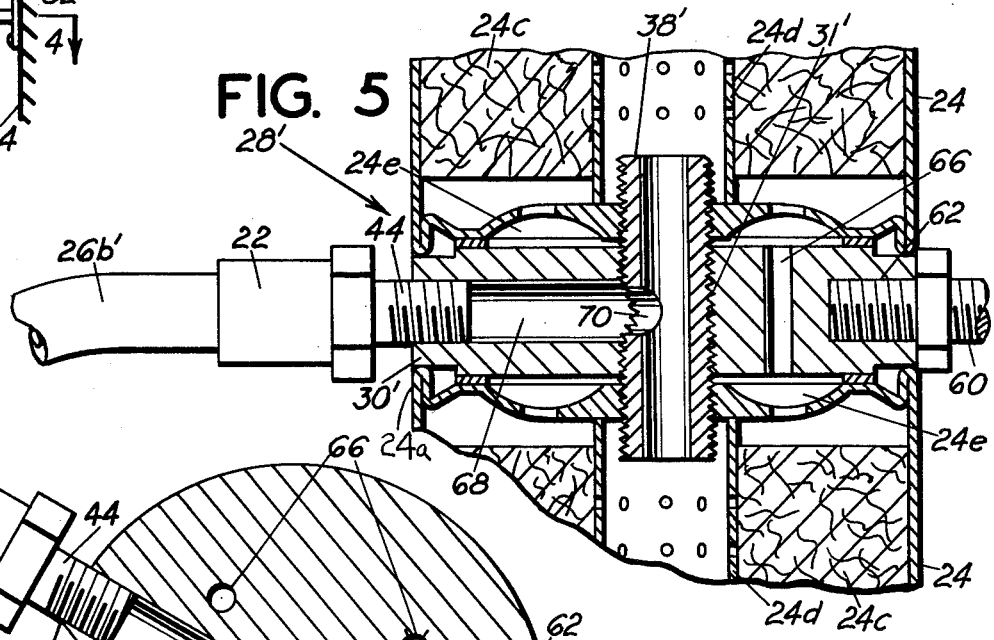
FIG. 5 is a fragmentary sectional view taken on the line 5—5 of FIG. 4.
Figure 4:
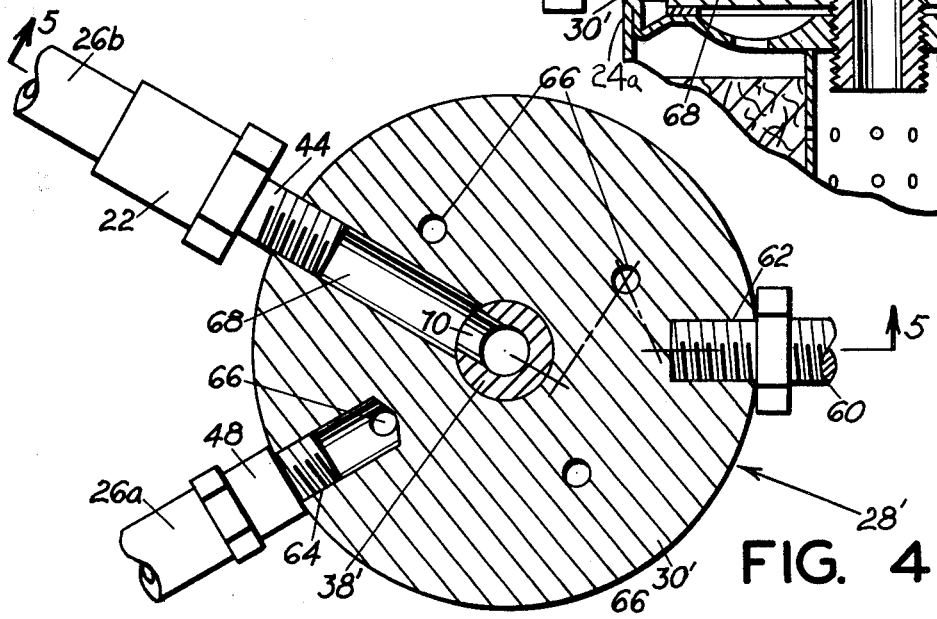
FIG. 4 is an enlarged fragmentary sectional view taken on the line 4—4 of FIG. 3.

FIGS. 3, 4 and 5 show an embodiment utilizing the same principles as that shown in FIG. 2 except that the filter support 28′ has provision for holding two filters 24, one projecting upwardly and the other projecting downwardly. For this purpose, the body member 30′ of this embodiment has a tapped axial bore 31′ arranged to threadedly receive a straight hollow stud 38′ projecting both above and below the body member for holding the top and bottom filters. The body member is integral with a bracket 32′ adapted to be secured to the vehicle, such bracket having an integral projecting stud 60 for engagement in a short radial tapped bore 62 in the body member 30′. Fitting 48 for the one end of conduit section **26*a*, namely the section extending from the valve cover, is threadedly engaged in a radial tapped bore 64 in the body member 30′. Bore 64 has communication with one of several vertical passageways 66 arranged in an annular pattern around the member 30′ and offset from the center of the latter so as to provide an inlet into the filters. These passageways are in communication at the upper and lower sides of the member 30' by the annular recess 24*e*** provided in the filters.

A radial bore 68 extends from a central point in communication with the interior of stud 38', by means of an aperture 70 in said stud, to the exterior of the member 30' where a fitting 44 for the pollution control valve 22 is attached, an outward portion of the bore 68 being tapped to threadedly receive such fitting. Hose **26*b* extends from the pollution control valve 22 to the intake manifold as in FIG. 1.**

According to the invention, the conventional system of circulating the crankcase fumes from the valve cover back into the intake manifold is preserved, as is the use of the pollution control valve. It has been found that by adding a filter in the system that the amount of pollutants discharged from the exhaust is greatly decreased and the mileage per gallon substantially increased. The type of filter used may vary but it has been found that the conventional spin-on oil filter commonly in use provide good results. Any suitable filter that traps solid particles in the fumes as well as some vapors may be used.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A filter for use in an emission control system of vehicles of the type having a crankcase, fuel intake means including a fuel mixing device, a valve cover, a conduit extending from the valve cover to the fuel intake means ahead of the fuel mixing device to direct crankcase fumes to the fuel intake, and a pollution control valve in the conduit, said filter comprising a. a disc-like body member having opposite face surfaces, b. means on said body member arranged to secure it to a vehicle, c. a stud member threadedly supported axially in said body member and projecting beyond one face surface thereof, d. a spin-on type filter having inlet and outlet portions and also having a threaded bore engageable by said stud member to provide removable mounting of said filter on said body member, e. inlet means in said body member arranged to connect a conduit which extends from a valve cover into said inlet portion of said filter, f. and outlet means in said body member arranged to connect a conduit from the outlet portion of said filter to a pollution control valve.

2. The filter of claim 1 wherein said stud member projects beyond both of said faces of the body member and is arranged to hold a filter on each side of said body member for double filtering.

* * * * *